US007219956B2

(12) United States Patent
Zhang

(10) Patent No.: US 7,219,956 B2
(45) Date of Patent: May 22, 2007

(54) CONVERTIBLE STOOL

(75) Inventor: Shouyun Zhang, Chino Hills, CA (US)

(73) Assignee: Larin Corporation, Ontario, CA (US)

( * ) Notice: Subject to any disclaimer, the term of this patent is extended or adjusted under 35 U.S.C. 154(b) by 0 days.

(21) Appl. No.: 11/041,140

(22) Filed: Jan. 21, 2005

(65) Prior Publication Data

US 2006/0102816 A1 May 18, 2006

Related U.S. Application Data

(60) Provisional application No. 60/629,123, filed on Nov. 17, 2004.

(51) Int. Cl.
*A47C 9/00* (2006.01)
*A47C 9/02* (2006.01)
*A47C 7/50* (2006.01)

(52) U.S. Cl. ..... 297/195.11; 297/215.16; 297/344.12; 297/344.19; 297/423.1; 297/423.36; 297/423.38; 297/423.45; 297/461

(58) Field of Classification Search ..... 297/195.11, 297/195.1, 215.16, 344.12, 423.1, 423.45, 297/423.36, 423.38, 461; 248/677, 188.8, 248/188.9, 346.11, 129; 16/37, 38, 42 T
See application file for complete search history.

(56) References Cited

U.S. PATENT DOCUMENTS 3,233,942 A * 2/1966 Creutz ..... 297/463.2
RE27,255 E * 12/1971 Pierson, Jr. ..... 297/259.4
4,037,292 A * 7/1977 Lapham ..... 16/38
4,621,804 A * 11/1986 Mueller ..... 297/6
5,439,269 A * 8/1995 Cheng ..... 297/461 X
5,964,436 A * 10/1999 Battey et al. ..... 248/188.8 X
6,003,944 A * 12/1999 Glockl ..... 297/423.1 X
6,095,464 A * 8/2000 du Rees ..... 248/188.8 X
6,116,690 A * 9/2000 Larson ..... 297/344.19
6,419,319 B1 * 7/2002 Sakurai ..... 297/344.12
6,481,795 B1 * 11/2002 Pettibon ..... 297/195.11
6,626,404 B2 * 9/2003 Kleinikel et al. ..... 248/129 X
6,637,072 B2 * 10/2003 Footitt et al. ..... 248/188.7
6,709,052 B2 * 3/2004 Jalkanen ..... 297/195.11
2003/0151291 A1 * 8/2003 Lin et al. ..... 297/423.38
2004/0206864 A1 * 10/2004 McAnulty ..... 248/188.8

* cited by examiner

*Primary Examiner*—Rodney B. White
*Assistant Examiner*—Stephen D'Adamo
(74) *Attorney, Agent, or Firm*—Greenberg Traurig LLP

(57) ABSTRACT

A convertible stool is interchangeable between a utility function which has a seat movable up and down and has casters as feet at the end of legs connected with the seat through an upstanding member. In a second use, the casters are replaced by feet to give stability to the chair on a floor or base. As such, the second use can be a furniture type use.

4 Claims, 3 Drawing Sheets

CONVERTIBLE STOOL

RELATED APPLICATION

This application claims priority to Provisional Application No. 60/629,123, filed Nov. 17, 2004, the contents of which are incorporated herein in their entirety.

BACKGROUND

1. Field

This disclosure relates to a stool which has multiple purposes.

2. General Background

It is desirable to have stools that can perform different functions and purposes and as such can have different characteristics and uses.

SUMMARY

This disclosure relates to a stool that serves a utility function and in this sense has a seat which can move upwardly and downwardly as required by a user. The user can operate a pneumatic mechanism to make the seat settle at a desired height so that utility functions can be performed. The seat is preferably mounted on a single pneumatic post and there are legs splayed out from the post and casters at the end of the legs, which act as movable feet for this stool. The stool acts as a utility stool with maneuverability as required by a user.

In a different sense, the casters are replaceable and stationary feet are put in location on the legs. This permits the stool to constitute furniture-like function that is stationary on its base. The stool can be raised or lowered as necessary on the central spindle or pillar.

Other objects and features of the disclosure will become apparent from the following detailed description and accompanying drawings.

DRAWINGS

DESCRIPTION

Figure 1:
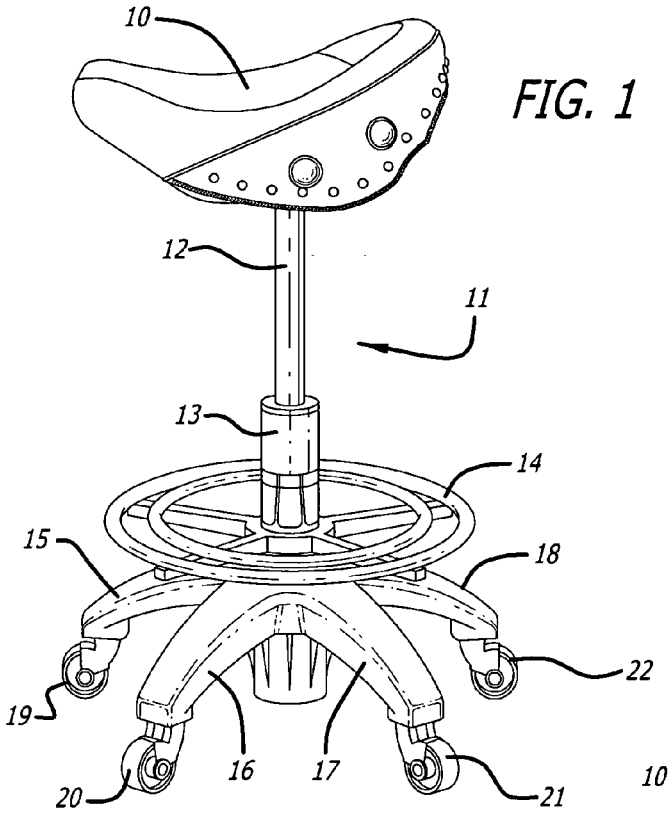
FIG. 1 is a perspective view of a stool showing the extended position of the seat relative to the legs of the chair in a first format.

FIG. 1 shows a stool with a seat 10 extended above a spindle 11. The spindle 11 includes at least two components, a rod 12 which moves pneumatically inside a cylinder 13. A circular removable footrest 14 is arranged around the cylinder 13. Splayed outwardly from the pillar 11 are legs 15, 16, 17 and 18. A further leg is also part of the structure such that there are five legs for the stool. The legs are equidistant from a radial sense. At the end of each of the legs as shown in FIG. 1, there is a caster 19, 20, 21 and 22, respectively. This permits the stool in FIG. 1 to be rolled fairly easily on a surface on which a utility worker such as a garage worker would be working.

Figure 3:
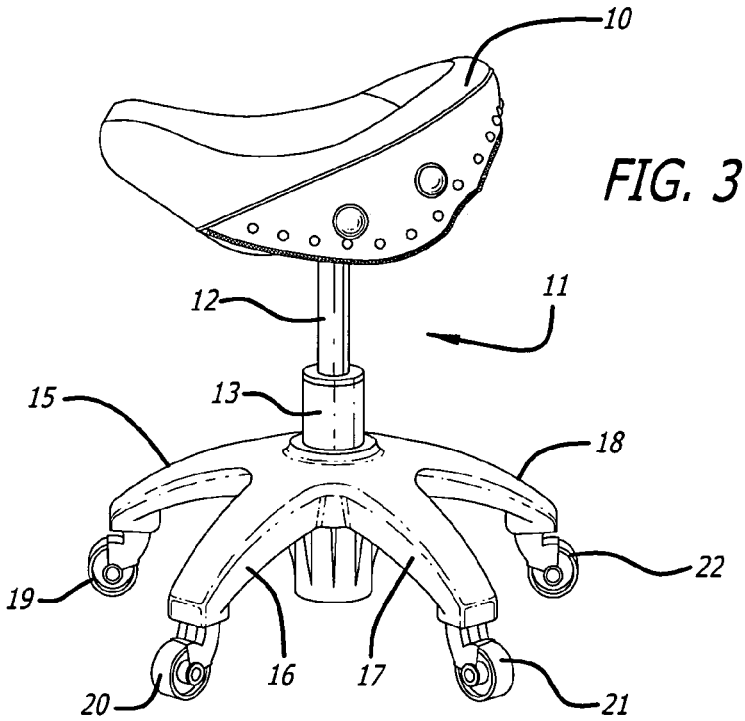
FIG. 3 is a perspective view of the stool in a lowered format as a utility stool.

As shown in FIG. 3, the rod 12 is compressed inside the cylinder 13. In this manner, the utility chair can be used around the surface, but the seat 10 is relatively lower. In this position the footrest is removed.

Figure 2:
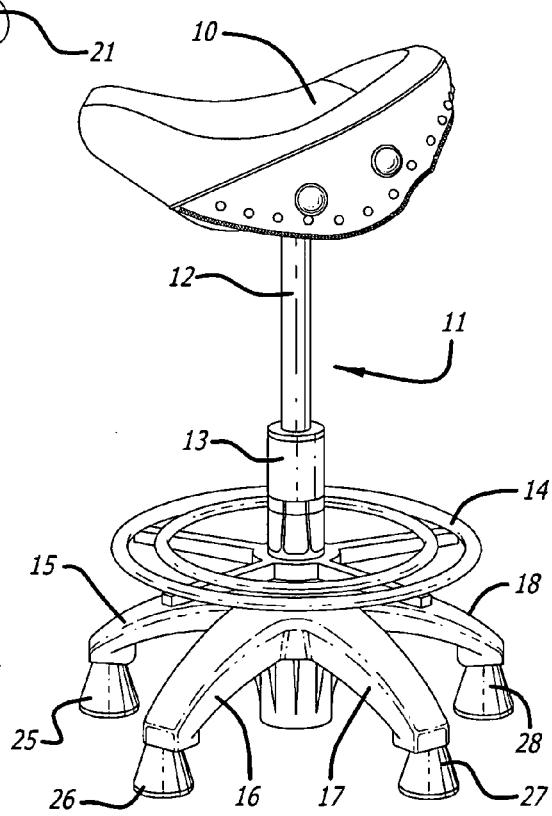
FIG. 2 is a perspective view of a stool showing the extended position of the seat relative to the legs of the chair in a second format.
Figure 4:
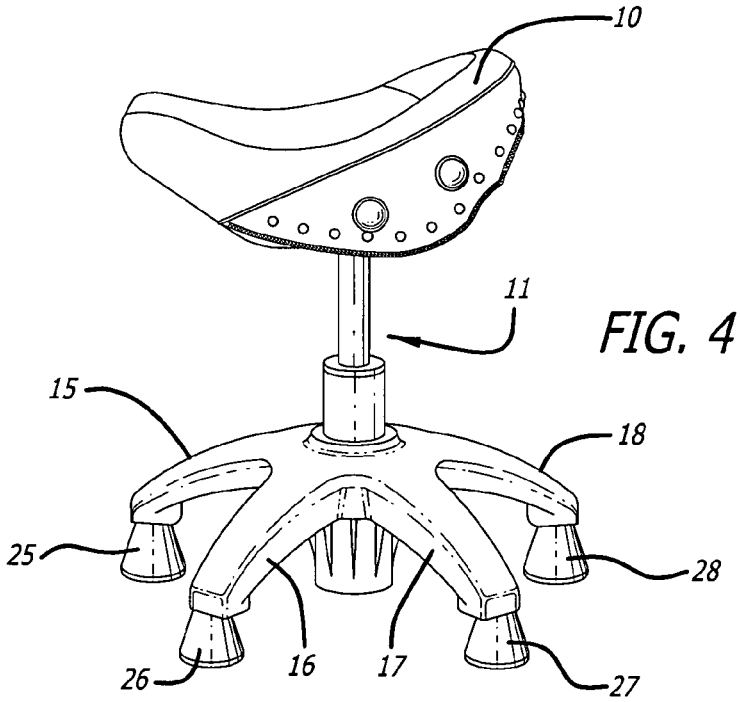
FIG. 4 is a perspective view of the stool in a lowered format as a furniture item.

As shown in FIGS. 2 and 4 there is the configuration where the stool is a fixed furniture item, namely where the feet are fixed elements. In place of the casters 19–22 and the fifth caster, there are fitted 5 feet.

In FIGS. 1 to 4 the seat as shown resembles a saddle similar to a motorcycle seat. The pneumatic adjustment of the rod and cylinder permits the seat to move between about 21 inches and 31 inches. The footrest in FIGS. 1 and 2 can be formed of a heavy-duty chrome material. In FIGS. 3 and 4 there is no footrest in that configuration. Thus, the footrest is removable, as required. When in a more compressed state, it may be unnecessary for a footrest. In the elongated state of FIGS. 1 and 2, the footrest becomes more necessary. It is possible in both the configurations of FIGS. 1 to 4 as shown to have the seat rotate or swivel 360° around the pillar 11.

Figure 5:
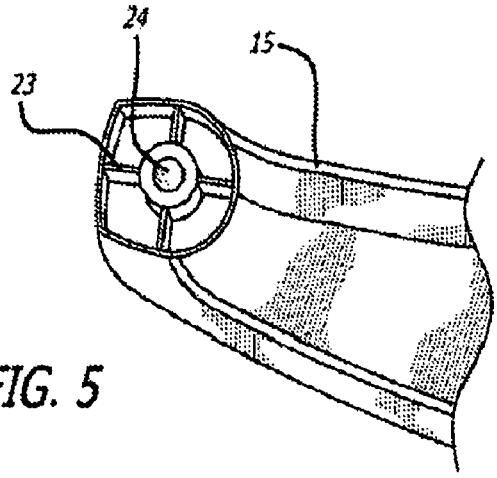
FIG. 5 is an underside view of a leg showing the extremity of the leg for locating either a caster or a foot.
Figure 6:
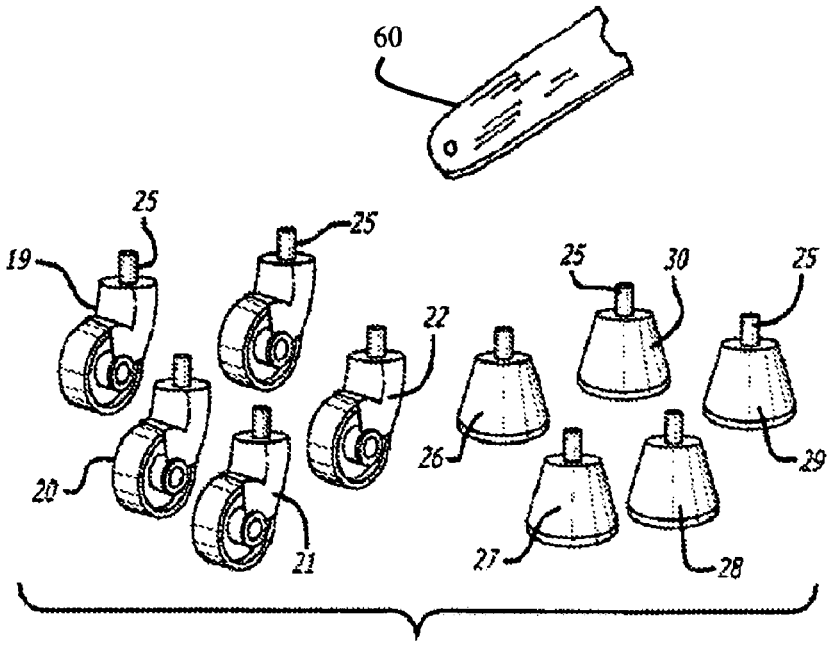
FIG. 6 is a view of kits of casters with a spindle and fixed feet with a spindle. The wedging tool to facilitate removal is also shown.

In FIG. 5, the underside 23 of a foot 15 can be seen. There is a central located axial hole 24 for engaging the spindle 25 of either the casters 19, 20, 21 and 22 and the fifth caster or of stationary feet 26, 27, 28, 29 or 30 as shown in FIG. 1-4. FIG. 6 shows the kits of casters and fixed feet which would interface with the different legs for the stool. A wedging-type tool 60 can be used to pry the casters 19, 20, 21 or 22 from the legs and replace them with the feet, or vice versa. The spindle 25 for the casters and for the stationary or fixed feet is sized to be the same so that it can easily fit in the hole at the underside of each of the extremities of the forward portions of the legs.

As can be seen when the stationary feet are used the outside surface of these feet meets with a relatively harmonious interface with the outside surface of the ends of the legs so that there is an aesthetically satisfying appearance achieved when the stationary feet are in place and stool is to be used as a furniture item.

The top of the feet at the interface with the spindle is in mating engagement with bottom of the interface 23 so as to have tight fitting contact which is aesthetically pleasing. The tool 60 can engage around the spindle 25 and be urged like a fork with tines that fit to either side of the spindle and between the ends of the legs and the top of the feet so that the feet can thereby be wedged from their engaged position in the hole. To have the feet with the spindle-leg configuration and conformation provides an effective mechanism for easy exchange of the feet as desired. The tool 60 is illustrated in FIG. 6 with the two tine-like formations or a groove for location to either side of the spindle. The body of the tool 60 is relatively thin with a narrowed or tapered forward part to facilitate the placement between the top of the feet and the bottom of the legs.

The stool can be packaged as a set or kit with the wedging tool 60 so that the appropriate feet can be used as desired by the consumer at the appropriate time.

In this manner there is provided a stool that is convertible between multi-functional purposes. When the feet are in place, the stool can provide an effective furniture item which can be used for instance in a bar, and in this sense, the seat 10 can be raised or lowered as necessary to a particular counter height. Alternatively, the stool in its fixed relationship can be a useful furniture item in a home, such as in a kitchen or the like.

As such there is provided a kit for a multi-functional convertible stool which comprises a saddle seat adjustable in height relative to a base on which the seat stands. There are multiple legs arranged to support the seat, the legs being connected with the seat, the legs having extremities and the legs having selectively removable feet. There are feet being casters and feet being stationary feet. The stool is convertible such that in one configuration with casters on the legs, the seat is movable on a base or floor and in a different configuration with stationary feet, the seat is relatively stationary on the base or floor.

The saddle seat is movable on a pneumatically mounted pillar which extends between the legs and the seat, thereby to vary the height of the saddle seat relative to the floor.

A method of converting a stool which is multifunctional as a utility stool in a first mode including the steps of applying removable casters to feet for a stool such that the stool can be moved on casters that facilitate rolling movement on a floor so as to permit movement around a workspace without the need for a user to get off a seat.

The seat is permitted to be raised or lowered according to the suitable height for use as a utility function around the workspace.

When the casters are removed and removable non-movable feet are applied in a second mode the stool acts as a furniture item which is not rollable on the floor. The legs including the non-movable feet are such that the stool can be located in a fixed relationship relative to a floor except if physically dragged in a non-rolling manner to a different location.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures.

The invention claimed is:

1. A kit for a multi-functional convertible stool comprising:

a saddle seat adjustable in height relative to a base on which the seat stands;

only a single pillar extending between multiple legs and the seat, the multiple legs being splayed radially from a central location, the single pillar being located at the central location; the seat being able to swivel about the single pillar;

the multiple legs arranged to support the seat, the legs being connected with the seat, the legs having extremities, the legs have a bottom face, and a hole in the bottom face, and the legs having selectively removable and interchangeable feet;

feet being casters;

feet being stationary bases; and a tool for removal of the feet;

the stool being convertible such that in one configuration with casters on the legs, the seat is movable on a base or floor and in a different configuration with stationary bases, the seat is relatively stationary on the base or floor; and wherein both the casters and the stationary bases have a top face, wherein both the casters and stationary bases have a spindle for locating both the casters or the stationary bases in the hole depending on the selected movable or stationary configuration of the stool, wherein the top face of the respective casters and stationary bases are oppositely located with the bottom face of the respective legs and wherein the spindle of each of the casters and stationary bases enters and provides tight fitting contact with the respective hole in the bottom face of the respective legs securing the casters and stationary bases with the legs;

and wherein an interface between the top face of the caster, and stationary bases and the bottom face of the legs sufficiently receives the tool and facilitates easy removal and replacement of the feet to convert into the two different configurations.

2. A kit as claimed in claim 1, wherein the saddle seat is movable on a pneumatically mounted pillar which extends between the legs and the seat, thereby to vary the height of the saddle seat relative to the floor.

3. The kit of claim 1 wherein the tool is a wedge-type tool.

4. The kit of claim 1 wherein the tool engages the spindle on the feet, facilitating removal of the feet.

* * * * *